United States Patent [19]

Dana

[11] Patent Number: 4,910,982

[45] Date of Patent: Mar. 27, 1990

[54] SELF-ASSEMBLING LOCKING DEVICE

[75] Inventor: Merrill A. Dana, Millbury, Mass.

[73] Assignee: Engineered Security Products Corporation, Leominster, Mass.

[21] Appl. No.: 258,214

[22] Filed: Oct. 14, 1988

[51] Int. Cl.[4] ..... E05B 9/08

[52] U.S. Cl. ..... 70/370; 70/451

[58] Field of Search ..... 70/367, 370, 371, 373, 70/375, 447, 448, 449, 451

[56] References Cited

U.S. PATENT DOCUMENTS

| | | | |
|---|---|---|---|
| 3,465,557 | 9/1969 | Ryder | 70/367 |
| 3,748,881 | 7/1973 | Erickson | 70/388 |
| 4,106,317 | 8/1978 | Anderson | 70/388 |

*Primary Examiner*—Robert L. Wolfe

*Attorney, Agent, or Firm*—Joseph S. Iandiorio; Brian M. Dingman

[57] ABSTRACT

A self-assembling locking device including a shell unit with a longitudinal bore, a retaining rim at the front end, and a mounting hole at the rear end. The shell unit further includes means for securing it in a panel aperture which is larger than the shell unit and smaller than the rim. Also included is a plug unit for assembly into the longitudinal bore through the mounting hole. The locking device further includes retaining means for interlocking the plug and shell units and preventing withdrawal of the plug unit form the shell unit through the mounting hole. There is also included means for rotating the plug unit between first and second operative positions.

36 Claims, 2 Drawing Sheets

SELF-ASSEMBLING LOCKING DEVICE

FIELD OF INVENTION

This invention relates to a self-assembling locking device and more particularly to such a device including a plug and shell simultaneously assembled and mounted in a panel.

BACKGROUND OF INVENTION

Many locks and latches have been devised for use in panels, for example, automobile doors, lock boxes, and tool boxes. The locks often include a shell and rotating plug lock assembly fitted into the door panel. The lock assembly is typically held tightly in the panel by an annular flange slipped over the assembly from the back side of the panel. The flange may be held in place on the lock assembly by means of complementary threads or other means, for example, retaining springs or lugs, to tightly hold the lock assembly in the panel. The bolt or actuating device is then attached to the back end of the lock assembly by means of screws, bolts, or retaining clips to complete installation. This type of lock has been shown in U.S. Pat. Nos. 4,381,66 and 4,186,952.

Although these door panel locks function well, they typically include many parts. Often, several parts must be assembled after the lock is fitted in the panel. This makes the locks relatively difficult and time-consuming to install. In addition, the means for holding the locks in the panels often require close-fitting tolerances between the lock and the panel hole. These problems contribute as well to the expense of producing and installing the locks. Since panel latches and locks are ubiquitous, there is a great need for a device which is functional, yet simple to manufacture and install.

SUMMARY OF INVENTION

It is therefore an object of this invention to provide a lock or latch which may be made from only two parts.

It is a further object of this invention to provide a lock or latch which is assembled upon installation in a panel.

It is a further object of this invention to provide a lock or latch which is assembled in a panel in only two steps.

It is a further object of this invention to provide a lock or latch in which the plug is snap-locked into the shell after the shell is snap-locked into the panel.

This invention results from the realization that an extremely inexpensive, two-piece panel lock or latch which is simultaneously assembled and installed in a panel may be accomplished by providing a shell which is inserted from the front side of the panel and locks therein, and a plug and bolt assembly which is then inserted and snap-locked in the shell from the back side of the panel to complete the lock assembly and installation.

This invention features a self-assembling locking device including a shell unit with a longitudinal bore, a retaining rim at the front end, and mounting hole at the rear end. The shell unit further includes means for securing it in a panel aperture which is larger than the shell and smaller than the retaining rim. The locking device also includes a plug unit for assembly into the longitudinal bore through the mounting hole. A bolt is preferably connected to the plug unit and protrudes beyond the mounting hole. Further included in the locking device are retaining means for interlocking the plug and shell units and preventing withdrawal of the plug through the mounting hole. Finally, the device includes means for rotating the plug unit in the shell unit between first and second operative positions.

The retaining means preferably includes a detent on one unit and a recess in the other unit for receiving the detent. The recess is preferably a peripheral groove which may extend at least partially circumferentially around the plug to allow the plug to rotate in the shell. The peripheral groove may be formed in the plug unit. Preferably, the detent is formed by the distal end of a flexible tongue attached to either the plug or shell and protruding into the longitudinal bore. The distal end may be disposed proximate the retaining rim.

The means for securing the shell in the panel aperture preferably includes a detent protruding from the shell for holding the shell to the panel with the panel between the detent and the rim. This detent may be formed by a flexible tongue attached to the shell with its distal end protruding from the shell proximate the rim. The means for securing the shell may also include means for preventing rotation of the shell relative to the panel.

The locking device also preferably includes means for limiting rotation of the plug unit, which means may include a stop member on the shell unit for engaging the plug unit. Preferably, there is further included some means for locking the plug unit to inhibit rotation relative to the shell unit. This may be accomplished with a locking recess in the plug and a locking detent on the shell for engaging the locking recess to hold the plug in the first operative position. The means for rotating may then include means for retraction the detent from the locking recess to allow the plug to rotate into the second operative position. The detent may be formed by a flexible tongue attached to the shell with its distal end protruding into the longitudinal bore for engaging the locking recess. The distal end may include a beveled portion for engaging the plug when it is inserted in the shell to push the flexible tongue out of the bore to allow the plug to fit by the tongue when the locking device is assembled. The means for locking the plug in the shell preferably further includes at least one position-defining recess in the plug for engaging the locking detent when the plug is in its second operative position.

The locking recess may be formed above a tumbler in the plug unit. In that case, there may be included means for biasing the tumbler into its locking position in which at least part of the tumbler lies below the surface of the plug unit to form the locking recess. In that case, the means for rotating may include means for selectively displacing the tumbler up to the surface of the plug to release the detent from the plug to allow the plug to rotate into the second operative position.

The tumbler may comprise the distal end of a flexible tongue attached to the plug. There may further be included a keyway in the plug for providing access to the tumbler. In that case, key means are provided for insertion in the keyway. The key means includes a bitted portion for engaging the tumbler to move it up to the surface of the plug to remove the locking recess and free the locking detent from the plug to allow the plug to rotate.

DISCLOSURE OF PREFERRED EMBODIMENT

Other objects, features and advantages will occur to one skilled in the art from the following description of a preferred embodiment and the accompanying drawings, in which.

Figure 6A:
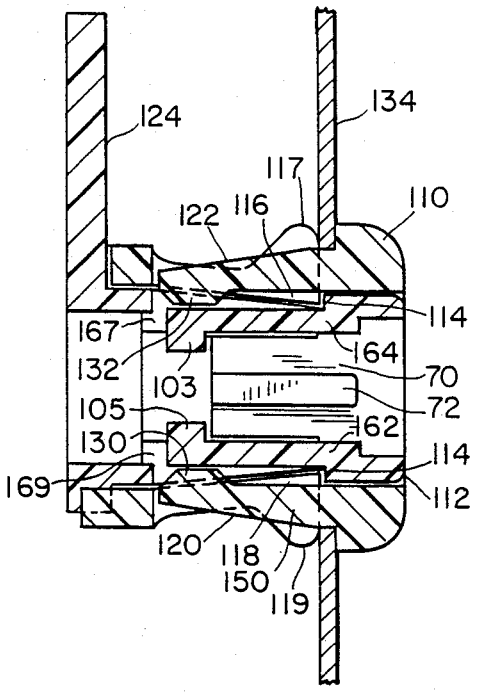
FIG. 6A is a sectional view similar to FIG. 2 of another preferred embodiment of the locking device according to this invention.
Figure 7:
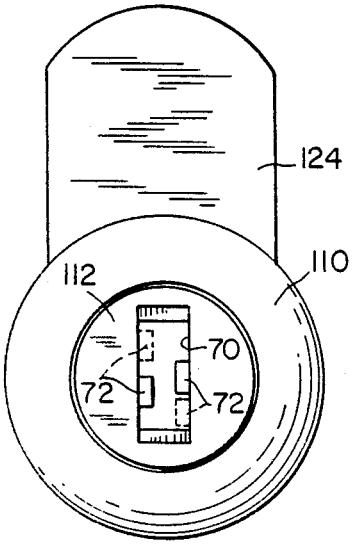

FIG. 7 a front elevational view of the device of FIG. 6A.

This invention features a self-assembling locking device which is preferably made from only two pieces and may be made entirely of plastic. The device includes a shell unit which is mounted in a panel mounting hole from the front side and locks therein. There is also a plug unit which s assembled through the rear end of the shell and locks in the shell to prevent its removal therefrom. The plug typically includes a bolt which performs the locking function.

Preferably, the locking device is molded from a plastic material, although any other material having some flexibility will suffice, including metals. The means for locking the plug in the shell, locking the shell to the mounting panel, and locking the plug to prevent its rotation in the shell are preferably accomplished with flexible tongues which are integrally formed in the plug and shell units and which act as detents to accomplish the locking.

Figure 1:
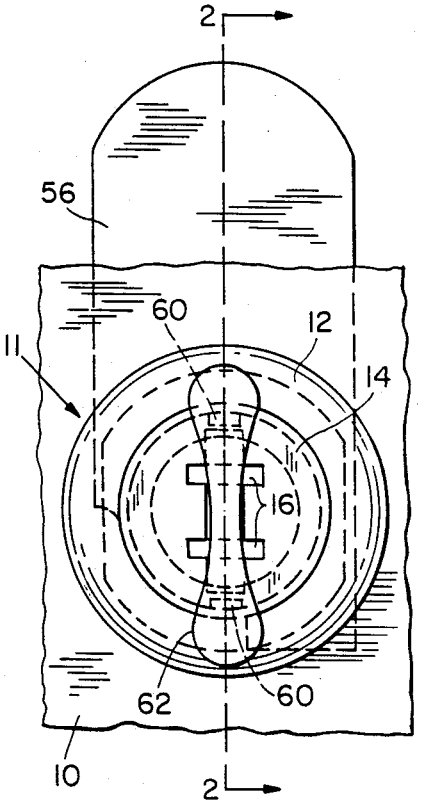
FIG. 1 is a front elevational view of a locking device according to this invention mounted in a panel.
Figure 2:
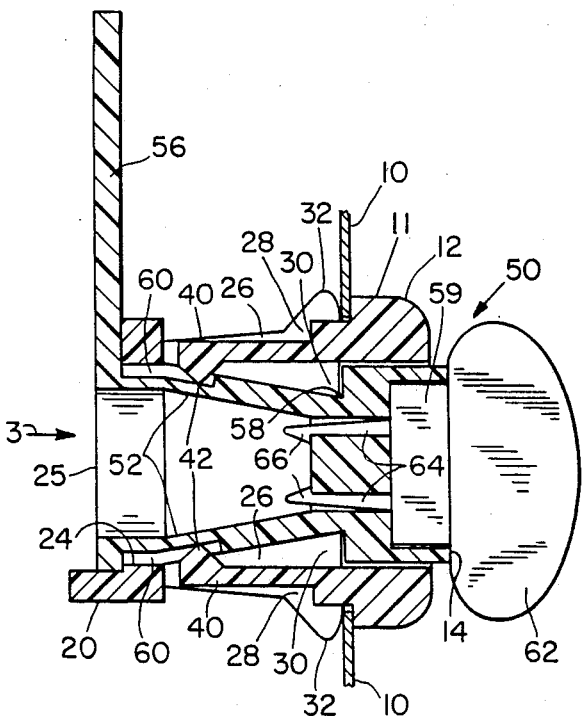
FIG. 2 is a sectional view taken along line 2—2 of FIG. 1.
Figure 3:
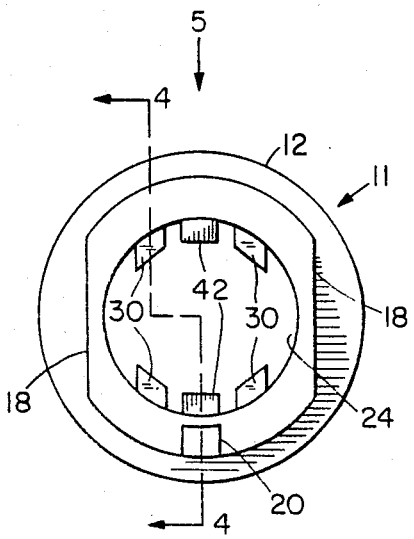
FIG. 3 is a rear elevational view of the shell unit of the looking device of FIG. 1 looking in the direction of arrow 3 in FIG. 2.

There is shown in FIG. 1 a self-assembling locking device according to this invention mounted in panel 10 which may be, for example, a cabinet door, toolbox, or lockbox. Each of the functional parts of the locking device is shown in FIG. 2. Shell 11 is mounted in panel 10 and presents annular flange 12 from the front view of FIG. 1. Mounted in shell 11 is plug 25, which presents face 14 from the front view of FIG. 1. Bolt 56 is integrally formed in plug 25 and turns with plug 25 from first to second operative positions to selectively lock and unlock the door or other structure.

Figure 4:
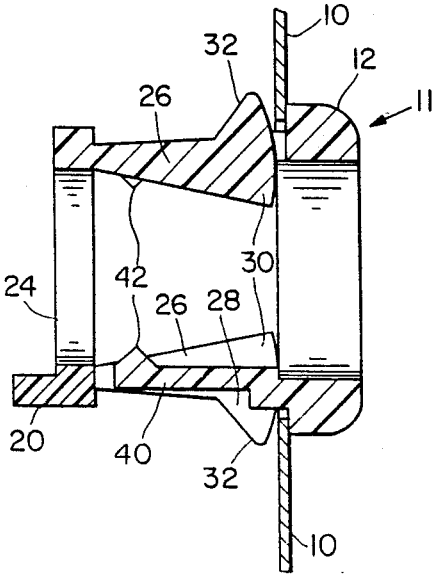
FIG. 4 is a sectional view taken on line 4—4 of FIG. 3.

Shell 11 is shown in more detail in FIG. 4 and includes central longitudinal bore 24 for receiving plug 25. Flexible tongues 26 are attached to shell 11 at its rear end and extend toward front face 12. Tongues 26 each include upper detent 32 and lower detent 30.

Shell 11 is assembled into panel 10 by pushing it into the panel aperture from right to left as shown in FIG. 4. The sloped face of detents 32 contact the edge of the panel and detents 32 are pushed down into longitudinal bore 24. When panel 10 passes by the tops of detents 32, tongues 26 spring or snap back because of their flexibility to their normal position shown in FIG. 4. Panel 10 is then held between enlarged annular end 12 and detents 32 to prevent the removal of the shell from the panel.

Plug 25 is then inserted into shell 11 through the rear end in the direction of arrow 3, FIG. 2. Plug 25 has generally tapered walls 52 tapering down from bolt 56 toward its front end. Enlarged front end 14 forms peripheral groove 58 in the surface of plug 25 where it meets the tapered plug body. As plug 25 is inserted into shell 11, enlarged end 14 contacts detents 30 of flexible tongues 26 and pushes tongues 26 up out of longitudinal bore 24. When enlarged end 14 has passed by the ends of detents 30, tongues 26 spring or snap back down into bore 24, causing detents 30 to seat in recess 58. This locks the plug in the shell to prevent the plug from being removed from the shell. Bolt 56 protrudes beyond opening 24 to prevent plug 25 from being pushed all the way through shell 11.

Keyholes 16, FIG. 1, in plug 25, are shaped to fit legs 64 of knob 62. Snap detents 66 are included on legs 64 to hold knob 62 in the lock. Knob 62 provides the means for rotating plug 25 in shell 11 to turn bolt 56 from a locking to an unlocking position.

In some applications it may be desirable to limit the extent of the rotation of plug 25 in shell 11. In that case, recesses 60 can be formed in plug body 52. Flexible tongues 40, an integral part of shell 11, extend from the front end of the shell toward its rear end and include detents 42, which sit in recesses 60. These recesses extend, for example, for approximately 90° around the circumference of plug 25, thereby limiting the rotation of plug 25° to 90°. Detents 42 are beveled on their rear faces s that enlarged end 14 can push tongues 40 up out of bore 24 when plug 25 is inserted in shell 11.

Viewed from the rear end in FIG. 4, plug 11 has visible in bore 24 detents 42 and 30. The body of shell 11 has flats 18 which fit in complementary flats in panel 10 to prevent shell 11 from rotating in panel 10 when the plug is rotated. Bolt stop member 20 protrudes from the end of shell 11 and provides a positive stop for bolt 56.

Figure 5:
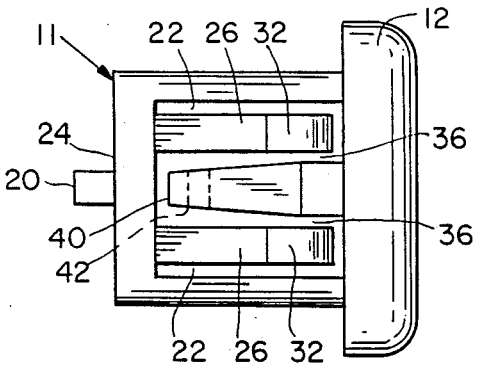
FIG. 5 is a top plan view of the shell unit of FIG. 3.

Shell 11 is shown from above in FIG. 5. Tongues 26 having detents 30 and 32 are formed by slots 22 and 36, which may be cut into shell 11 but are preferably molded therein. Tongue 40 is attached to the front end of shell 11 and includes detent 42, which fits into recess 60 in plug 25. It should be understood that tongue 40 is not required for the operation of the lock as a latch. However, as more fully explained below, tongues 40 provide the means for locking the plug in the shell when the locking device according to this invention is designed as a key-operated lock.

To operate the locking device as a key-operated lock, tongues 162 and 164, FIG. 6A, having detents 105 and 103 respectively, are included in plug 112. Detents 116 and 118 sit in groove 114 to lock plug 112 in shell 110. Detents 117 and 119 hold shell 110 to panel 134. Tongues 120 and 122 are formed as part of shell 110 and have detents 130 and 132, respectively. Detents 130 and 132 sit on tongues 164 and 162, Which extend below the tapered face of plug 112 to form recesses 167 and 169. Recesses 167 and 169 are just large enough to hold detents 132 and 130 therein and prevent plug 112 from rotating in shell 110. Wards 72 extend into keyway 70, FIG. 7. Wards 72 are shown in a second location in phantom, which provides a means for ensuring that only a key having the proper recesses to receive wards 72 can be inserted in keyway 70 to unlock the lock.

Figure 6B:
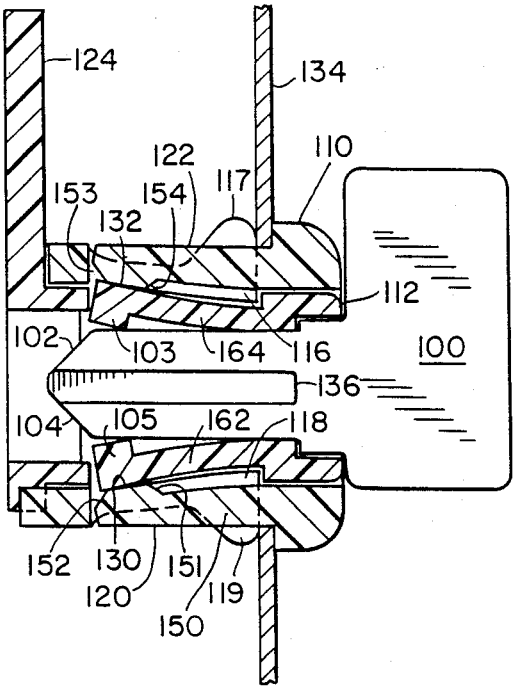
FIG. 6B illustrates the key locking feature of the embodiment of FIG. 6A.

The locking and unlocking action of the embodiment of FIG. 6A is more clearly shown in FIG. 6B. Key 100 having slot 136 for receiving one of wards 72 is inserted into keyway 70. Bitted portions 102 and 104 engage detents 103 and 105 to push tongues 164 and 162 out. Tongues 164 and 162 may be described as tumblers. Tongues 140 and 120 of shell 110 are thereby pushed out as well.

Detents 130 and 132 include front facing beveled portions 151 and 154 and rear facing beveled portions 152 and 153. Front portions 151 and 154 are included to allow shell 110 to be removed from its mold. Rear portions 152 and 153 are beveled so that when plug 112 is inserted in shell 110 the head of the plug can engage portions 152 and 153 to push detents 130 and 132 out of the longitudinal bore to allow plug 112 to pass by the detents. Because of the flexibility of tongues 120 and 140, after the enlarged head of plug 112 passes b detents 130 and 132 these detents Will spring back into their normal position in which they protrude into the longitudinal bore to provide the locking action.

Key 100 is designed to push tongues or tumblers 164 and 162 up to the surface of tapered plug 112 to remove locking recesses 167 and 169, FIG. 6A, which frees detents 130 and 132 to allow them to ride on the surface of plug 112. When key 100 is turned, detents 130 and 132 will slid along the surface of plug 112.

Plug 112 may include a second set of depressions or slots such as slot 60, FIG. 2, which are spaced 90° from slots 167 and 169, FIG. 6A. These slots may be formed simply by flattening the tapered shape of plug 112 to provide a flat resting surface for detents 130 and 132. Because the detents are flexible and are bearing on the flats with some force, the flats or depressions provide some resistance to turning, which defines a second operative position of plug 11, for example the unlocked position.

The locking device according to this invention is preferably made from a plastic material, which may be a polycarbonate/polyester alloy. This allows the device to be molded in only two pieces, one a shell unit including a longitudinal bore, a retaining rim at the front end, a mounting hole at the rear end, and means such as detents 32 for securing the shell unit in a panel aperture. The plug unit preferably integrally includes the bolt member which performs the locking or latching function. The shell and/or plug integrally include retaining means for interlocking the plug and shell to prevent withdrawal of the plug from the shell through the mounting hole. As a result, a simple locking device is provided which is simultaneously mounted in a panel and assembled. This greatly increases the ease of installation, and therefore reduces its cost.

Although specific features of the invention are shown in some drawings and not others, this is for convenience only as each feature may be combined with any or all of the other features in accordance with the invention.

Other embodiments will occur to those skilled in the art and are with the following claims:

What is claimed is:

1. A self-assembling locking device comprising:

a shell unit including a longitudinal bore with a retaining rim at the front end and a mounting hole at the rear end, and further integrally including means for securing said shell unit in an aperture in a panel, which aperture is larger than said shell unit and smaller than said rim, said means for securing also protruding into said bore; and a plug unit for assembly into said longitudinal bore through said mounting hole, said plug unit including a recess for receiving said means for securing to interlock said plug and shell units and prevent withdrawal of said plug unit from said shell unit after assembly.

2. The self-assembling locking device of claim 1 in which said recess includes a peripheral groove.

3. The self-assembling locking device of claim 2, in which said peripheral groove is at least partially circumferential for allowing said plug unit to rotate in said shell unit.

4. The self-assembling locking device of claim 1 in which said means for securing includes a flexible tongue with its distal end protruding into said longitudinal bore in its locking state.

5. The self-assembling locking device of claim 4 in which said distal end of said tongue is proximate said retaining rim.

6. The self-assembling locking device of claim 1 in which said means for securing said shell unit in the panel aperture includes a detent protruding from said shell unit for holding said shell unit to the panel with the panel between said detent and said rim.

7. The self-assembling locking device of claim 6 in which said detent includes a flexible tongue attached to said shell unit with its distal end protruding from said shell unit proximate said rim.

8. The self-assembling locking device of claim 1 in which said means for securing said shell unit includes means for preventing rotation of said shell unit relative to the panel.

9. The self-assembling locking device of claim 1 further including means for limiting the rotation of said plug unit.

10. The self-assembling locking device of claim 9 in which said means for limiting the rotation of said plug unit includes a stop member on said shell unit for engaging said plug unit.

11. The self-assembling locking device of claim 1 further including means for locking said plug unit to inhibit rotation relative to said shell unit.

12. The self-assembling locking device of claim 11 in which said means for locking includes a locking recess in said plug unit and a locking detent on said shell unit for engaging said locking recess to hold said plug unit in the first operative position.

13. The self-assembling locking device of claim 12 in which said means for rotating includes means for retracting said detent from said locking recess to allow said plug unit to rotate into the second operative position.

14. The self-assembling locking device of claim 12 in which said detent includes a flexible tongue attached to said shell unit with its distal end protruding into said longitudinal bore in its locking position for engaging said locking recess.

15. A self-addressing locking device comprising:

a shell unit including a longitudinal bore with a retaining rim at the front end and a mounting hole at the rear end, and further including means for securing said shell unit in an aperture in a panel, which aperture is larger than said shell unit and smaller than said rim;

a plug unit for assembly into said longitudinal bore through said mounting hole;

retaining means for interlocking said plug and shell units and preventing withdrawal of said plug unit from said shell unit through said mounting hole; and means for inhibiting rotation of said plug unit relative to said shell unit, said means for inhibiting rotation including a recess in said plug unit and a detent on said shell unit for engaging said recess to hold said plug unit in a first operative position, said detent including a flexible tongue attached to said shell unit with its distal end protruding into said longitudinal bore in its locking position for engaging said recess.

16. The self-assembling locking device of claim 15 in which said locking recess is formed above a tumbler in said plug unit.

17. The self-assembling locking device of claim 16 further including means for biasing said tumbler into its locking position wherein at least part of said tumbler is disposed below the surface of said plug unit to form said locking recess.

18. The self-assembling locking device of claim 17 in which said means for rotating includes means for selectively displacing said tumbler up to the surface of said plug unit into an unlocked position to release said detent from said plug unit to allow said plug unit to rotate into the second operative position.

19. The self-assembling locking device of claim 16 in which said tumbler comprises the distal end of a flexible tongue attached to said plug unit.

20. The self-assembling locking device of claim 17 in which said means for rotating includes a keyway in said plug unit for providing access to said tumbler.

21. The self-assembling locking device of claim 20 in which said means for rotating further includes key means for insertion in said keyway, said key means including a bitted portion for engaging said tumbler to move said tumbler to the surface of said plug unit and remove the locking recess to free said detent from said plug unit and allow said plug unit to rotate between said first and second operative positions.

22. The self-assembling locking device of claim 2 in which said peripheral groove is in said plug unit.

23. The self-assembling locking device of claim 13 in which said means for locking further includes at least one position-defining recess in said plug unit for engaging said locking detent when said plug unit is in the second operative position.

24. The self-assembling locking device of claim 1 in which said plug unit integrally includes a bolt member protruding beyond said mounting hole.

25. The self-assembling locking device of claim 15 in which said distal end of said flexible tongue includes a beveled portion for engaging said plug unit when said plug unit is inserted in said shell unit to temporarily displace said distal end from said longitudinal bore to allow said plug unit to pass by said distal end.

26. A two-piece, self-assembly locking device comprising:

a generally cylindrical shell, integrally including in a unitary structure a longitudinal bore with a retaining rim at the front end and a mounting hole at the rear end, said shell further including at least one locking detent and at least one holding detent, said detents formed integrally on and protruding from said shell and spaced circumferentially around said shell proximate said front end for holding a mounting panel between said rim and said detents to prevent withdrawal of said shell from the mounting panel, said locking detent protruding into said bore;

a generally cylindrical plug from assembly into said longitudinal bore through said mounting hole, said plug including an integral bolt member protruding beyond said mounting hole;

said plug having a peripheral groove for receiving said locking detent to interlock said plug and shell, for preventing withdrawal of said plug from said shell through said mounting hole, and for allowing said plug to rotate in said shell; and stop means integral with at least one of said units for defining locked and unlocked positions of said plug in said shell.

27. The self-assembling locking device of claim 26 in which said plug is generally tapered from the bolt member toward the end proximate said retaining rim.

28. The self-assembling locking device of claim 27 in which said plug includes an enlarged end proximate said retaining rim for forming said peripheral groove in said plug where said taper meets said enlarged end.

29. The self-assembling locking device of claim 26 in which said plug includes at least one locking tumbler interacting with said shell to prevent rotation of said plug in said shell.

30. The self-assembling locking device of claim 29 further including means for operating said tumbler to allow said plug to rotate in said shell.

31. The self-assembling locking device of claim 26 in which said locking device is made of a plastic material.

32. The self-assembling locking device of claim 26 in which said locking detent includes a flexible tongue attached to said shell with its distal end protruding into said longitudinal bore.

33. The self-assembling locking device of claim 32 in which said distal end is enlarged and protrudes from said shell to form said detent for securing said shell in the aperture.

34. A two-piece, self-assembling lock comprising:

a generally cylindrical shell integrally including in a unitary structure a longitudinal bore with a retaining rim at the front end and a mounting hole at the rear end, said shell further including four flexible tongues attached to said shell proximate said mounting hole and having enlarged distal ends protruding from said shell and also protruding into said longitudinal bore for holding said shell in an aperture in a mounting panel with the panel between said distal ends and said retaining rim to prevent removal of said shell from the mounting panel;

a generally cylindrical plug for assembly into said longitudinal bore through said mounting hole having a circumferential groove for engaging said distal ends of said flexible tongues to lock said plug in said shell, an integral bolt member protruding beyond said mounting hole, and a keyway for allowing insertion of a key; and means for locking said plug in said shell to prevent rotation of said plug and bolt member, including a flexible tongue integrally formed in said plug having its distal end proximate said bolt member, said distal end having a portion protruding into said keyway and a portion lying below the surface of said plug to form a locking recess in said plug, said means for locking further including a flexible locking tongue integrally formed in said shell having its distal end protruding into said locking recess for locking said plug and said shell, said portion protruding into said keyway being displaced upon insertion of a bitted key inserted into said keyway to displace the portion lying below the surface up to the surface of said plug to remove said distal end of said locking tongue from said locking recess to free said plug and bolt member to rotate in said plug.

35. A two-piece self-assembling locking device with the pieces mutually rotatable between first and second positions comprising:

a shell unit including a longitudinal bore with a retaining rim integrally formed at the front end and a mounting hole at the rear end, and further integrally including means for securing said shell unit in an aperture in a panel, which aperture is larger is larger than said shell unit and smaller than said rim;

a plug unit for assembly into said longitudinal bore through said mounting hole;

retaining means integral with at least one of said units for interlocking said plug and shell units and preventing withdrawal of said plug unit from said shell unit through said mounting hole; and means integral with at least one of said units for preventing rotation of said plug unit relative to said shell unit.

36. The self assembling locking device of claim 1 further including means for rotating said plug unit between first and second operative positions.

* * * * *